US009822570B2

(12) United States Patent
Jaranson et al.

(10) Patent No.: US 9,822,570 B2
(45) Date of Patent: Nov. 21, 2017

(54) AUTOMATICALLY CLOSING VEHICLE DOOR

(71) Applicant: Ford Global Technologies, LLC, Dearborn, MI (US)

(72) Inventors: John W. Jaranson, Dearborn, MI (US); Raj Nair, Ann Arbor, MI (US); Randal Henry Visintainer, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/083,591

(22) Filed: Mar. 29, 2016

(65) Prior Publication Data

US 2017/0284142 A1 Oct. 5, 2017

(51) Int. Cl.

| | |
|---|---|
| ***E05F 5/02*** | (2006.01) |
| ***E05F 3/22*** | (2006.01) |
| ***E05F 1/10*** | (2006.01) |
| ***E05C 17/00*** | (2006.01) |
| ***E05C 17/12*** | (2006.01) |
| ***E05F 15/60*** | (2015.01) |

(Continued)

(52) U.S. Cl.

CPC ..... *E05F 3/222* (2013.01); *E05B 47/0004* (2013.01); *E05C 17/003* (2013.01); *E05C 17/12* (2013.01); *E05F 1/10* (2013.01); *E05F 1/1008* (2013.01); *E05F 3/221* (2013.01); *E05F 15/60* (2015.01); *E05F 15/70* (2015.01); *E05B 2047/0048* (2013.01); *E05B 2047/0068* (2013.01); *E05Y 2900/531* (2013.01)

(58) Field of Classification Search

CPC . E05F 3/222; E05F 1/1008; E05F 1/10; E05F 15/70; E05F 15/60; E05C 17/12; E05C 17/003; E05B 47/0004; Y10T 16/6295

USPC ..... 16/82, 83, 85, DIG. 17, 86 C

See application file for complete search history.

(56) References Cited

U.S. PATENT DOCUMENTS

| | | | | |
|---|---|---|---|---|
| 2,032,600 A * | 3/1936 | Smith | ..... | E05C 17/203 16/86 C |
| 4,342,135 A * | 8/1982 | Matsuo | ..... | F16F 9/12 16/225 |

(Continued)

FOREIGN PATENT DOCUMENTS

| | | | | |
|---|---|---|---|---|
| JP | 200530080 A | 2/2005 | | |
| JP | CA 2541656 A1 * | 10/2006 | ..... | E05C 17/203 |
| WO | 2013170363 A1 | 11/2013 | | |

OTHER PUBLICATIONS

"Mazda releases new mazda mobile start app with door lock, panic alarm and carfinder", Telematics Wire, Jul. 13, 2015, http://telematicswire.net/mazda-releases-new-mazda-mobile-start-app-with-door-lock-panic-alarm-and-carfinder/.

*Primary Examiner* — Jerry Redman

(74) *Attorney, Agent, or Firm* — Frank A. MacKenzie; Bejin Bieneman PLC

(57) ABSTRACT

A door assembly for a vehicle includes a door and a check strap pivotally coupled to the door. An engagement member is releasably engageable with the check strap. A spring is positioned to bias the check strap toward the engagement member. When the engagement member is engaged with the check strap, the check strap maintains the door in an open position. When the engagement member is disengaged with the check strap, the door is swung to the closed position under the bias of the spring.

15 Claims, 8 Drawing Sheets

(51) Int. Cl.
*E05F 15/70* (2015.01)
*E05B 47/00* (2006.01)

(56) References Cited

U.S. PATENT DOCUMENTS 4,639,969 A * 2/1987 Obenshain ..... E05F 3/221 16/65
5,074,010 A * 12/1991 Gignac ..... E05C 17/206 16/334
5,553,353 A * 9/1996 Lin ..... E05F 3/06 16/59
6,523,376 B2 2/2003 Baukholt et al.
6,557,209 B1 * 5/2003 Wood ..... E05C 17/443 16/82
6,711,778 B2 * 3/2004 Sparkman ..... E05C 17/203 16/82
6,739,646 B2 5/2004 Suzuki et al.
6,901,630 B2 * 6/2005 Liang ..... E05C 17/203 16/82
7,240,399 B2 * 7/2007 Murayama ..... E05C 17/203 16/82
7,827,836 B2 11/2010 Cetnar
7,908,709 B2 * 3/2011 Cruz ..... E05C 17/203 16/86 B
8,151,610 B2 4/2012 Fujihara
8,347,460 B2 * 1/2013 Minegishi ..... E05D 11/1057 16/333
8,414,062 B2 * 4/2013 Gobart ..... E05D 11/1028 16/82
8,733,818 B2 * 5/2014 Hooton ..... E05C 17/203 16/86 C
9,322,204 B2 * 4/2016 Suzuki ..... E05F 15/611
2001/0014993 A1 * 8/2001 Orita ..... E05F 5/00 16/82
2001/0022011 A1 * 9/2001 Vittorio ..... E05D 11/1042 16/334
2004/0251696 A1 * 12/2004 Murayama ..... E05C 17/203 292/262
2008/0271286 A1 * 11/2008 Stalhammar ..... E05C 17/203 16/84
2011/0266080 A1 * 11/2011 Schmitt ..... E05C 17/006 180/89.1
2012/0233813 A1 * 9/2012 Settsu ..... E05F 5/00 16/82
2015/0267444 A1 * 9/2015 Neag ..... E05C 17/203 16/82
2016/0024828 A1 * 1/2016 Murayama ..... B60J 5/00 16/83

* cited by examiner

AUTOMATICALLY CLOSING VEHICLE DOOR

BACKGROUND

Vehicles may be autonomously operated such that the vehicle may be driven without constant attention from a driver, i.e., the vehicle may be self-driving without human input. For example, the vehicle may be remotely operated by an automated computer system. When autonomously operated, the vehicle may be used in rental system and/or a ride-share system in which multiple occupants may interchangeably occupy the vehicle. In such situations, it is advantageous to ensure that the vehicle is in proper condition to travel before being autonomously operated.

DETAILED DESCRIPTION

Figure 1:
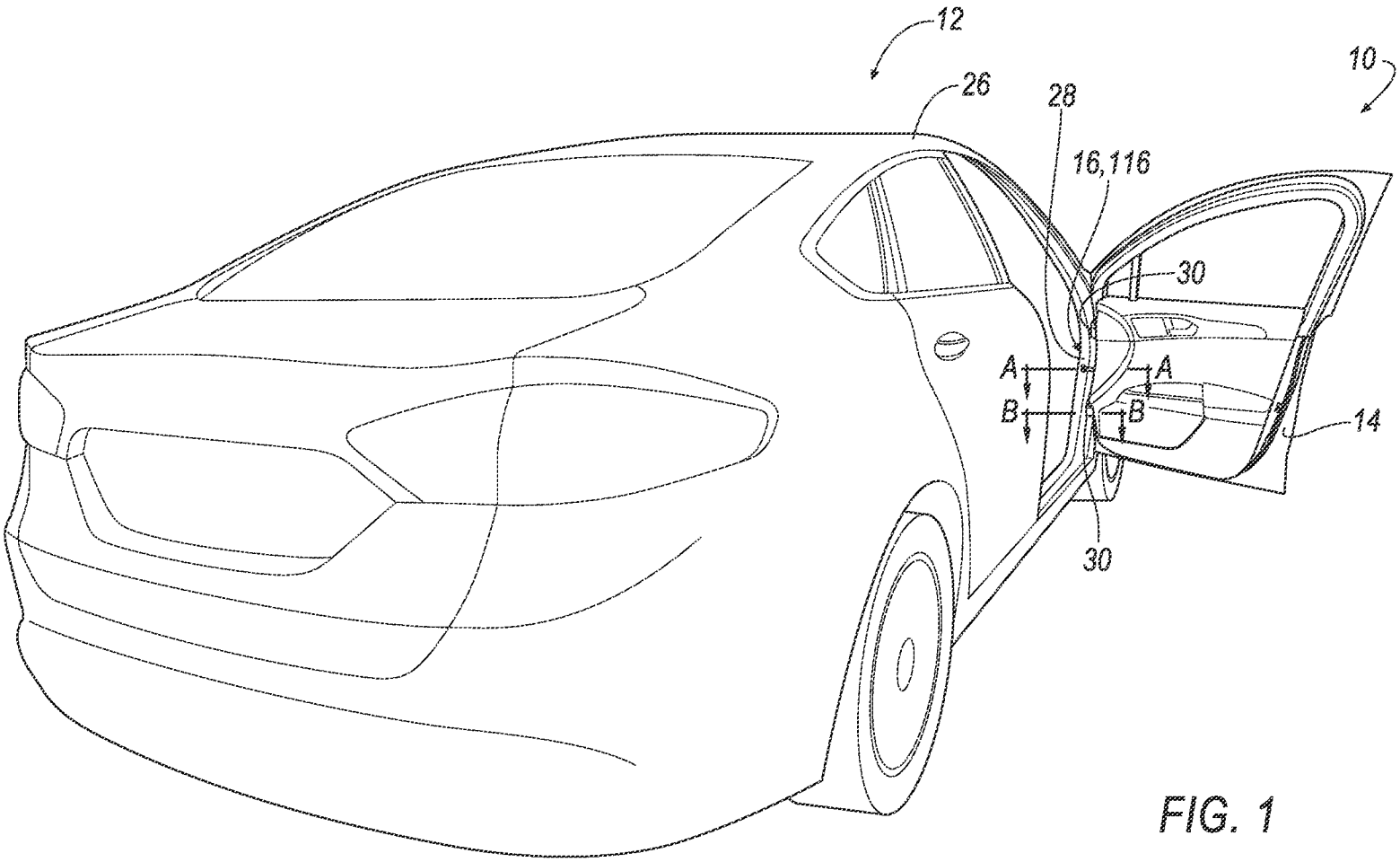
FIG. 1 is a perspective view of a vehicle with a door in an open position.

With reference to the Figures, wherein like numerals indicate like parts throughout the several views, a door assembly 10 for a vehicle 12 includes a door 14 and a check strap 16, 116 pivotally coupled to the door 14. An engagement member 18 is releasably engageable with the check strap 16, 116. A spring 44, 56 is positioned to bias the check strap 16, 116 toward the engagement member 18.

Figure 2:
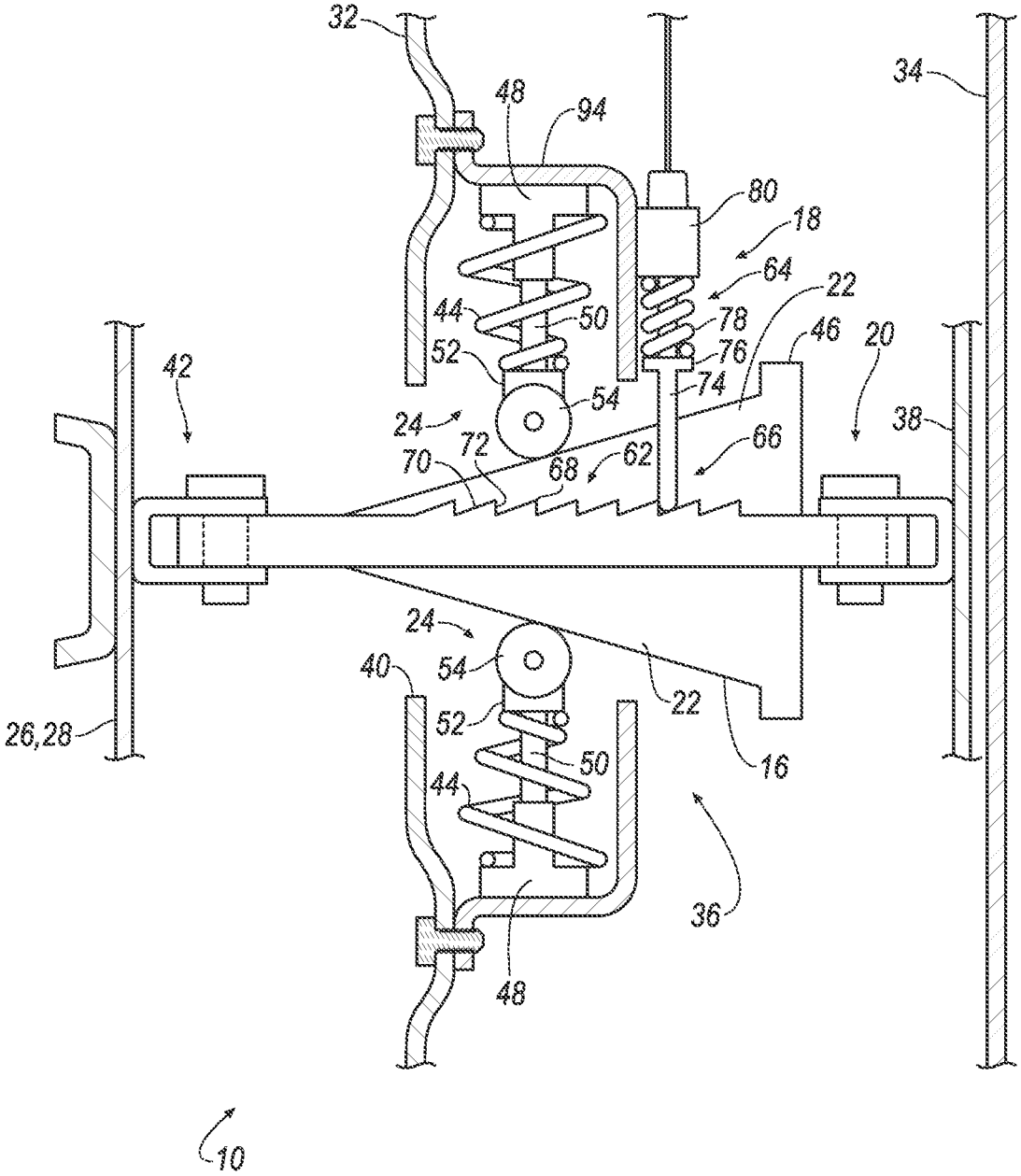
FIG. 2 is a cross-sectional view of a portion of the vehicle along line A of FIG. 1 and including one embodiment of a check strap and a spring.
Figure 3:
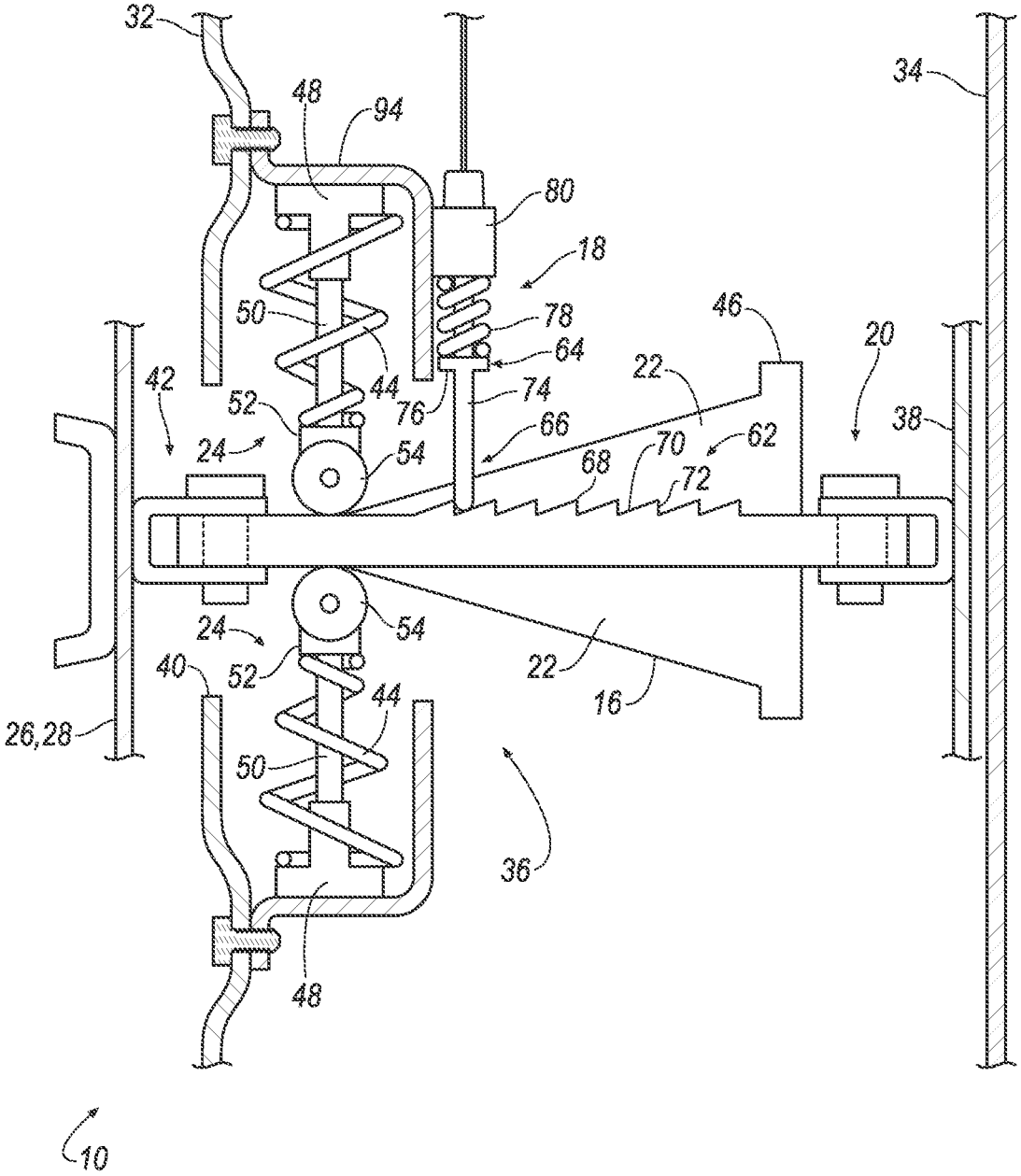
FIG. 3 is the cross-sectional view of FIG. 2 with the door in a closed position.
Figure 4:
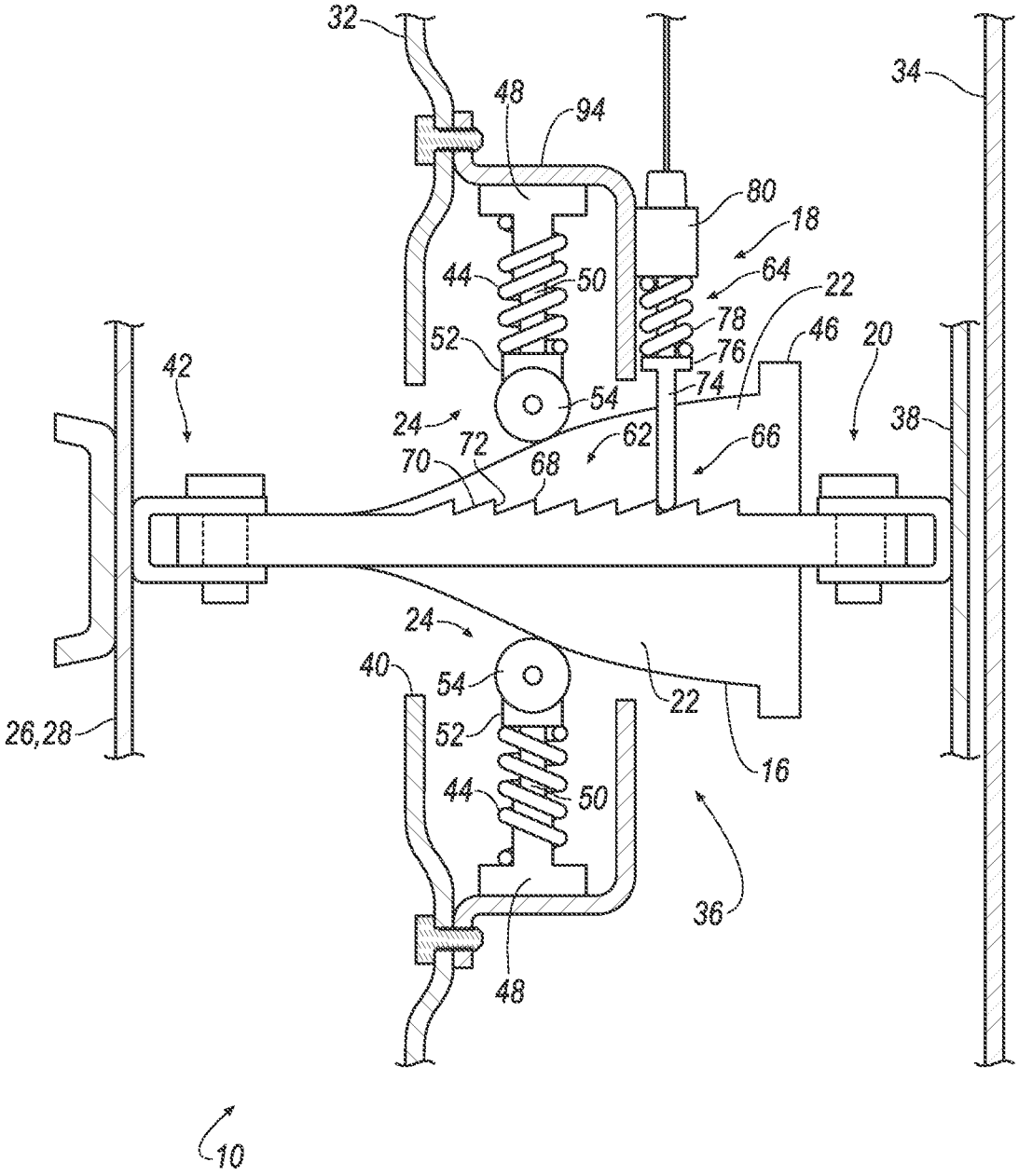
FIG. 4 is a cross-sectional view of a portion of the vehicle along line A of FIG. 1 and including another embodiment of the check strap and spring.
Figure 5:
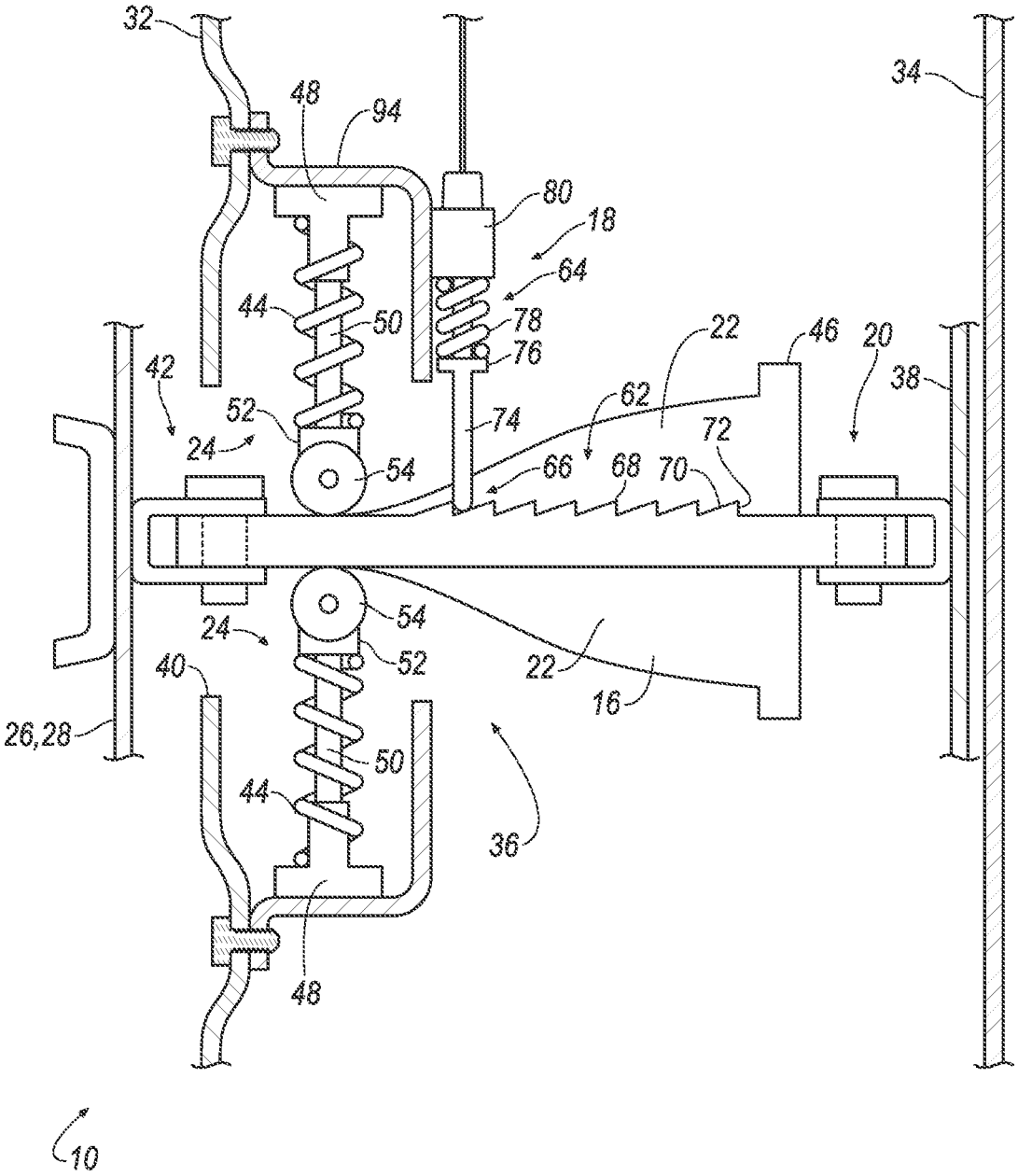
FIG. 5 is the cross-sectional view of FIG. 4 with the door in the closed position.
Figure 6:
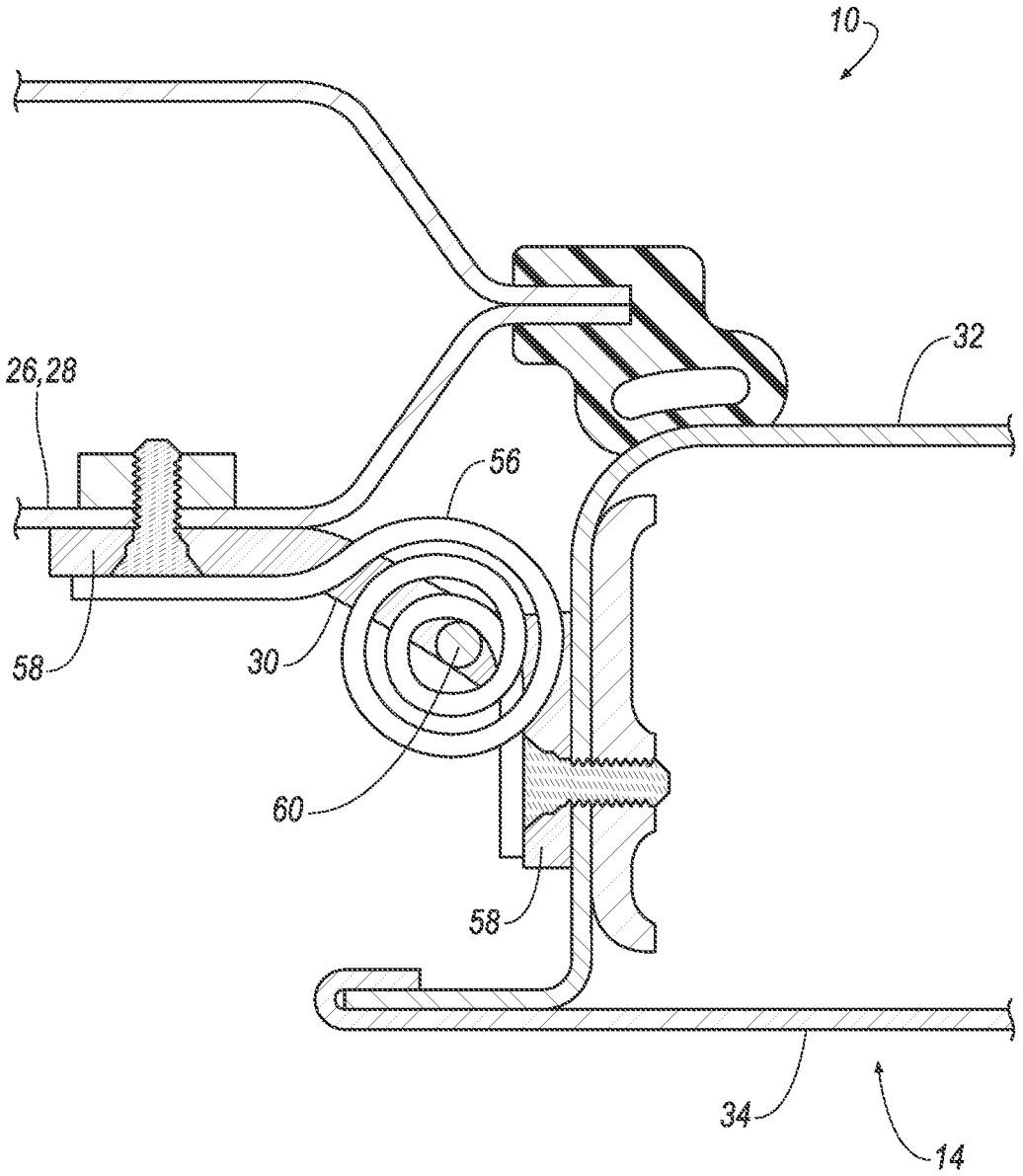
FIG. 6 is a cross-sectional view along line B of FIG. 1 when the door is in the closed position and including a second embodiment of a spring.
Figure 7:
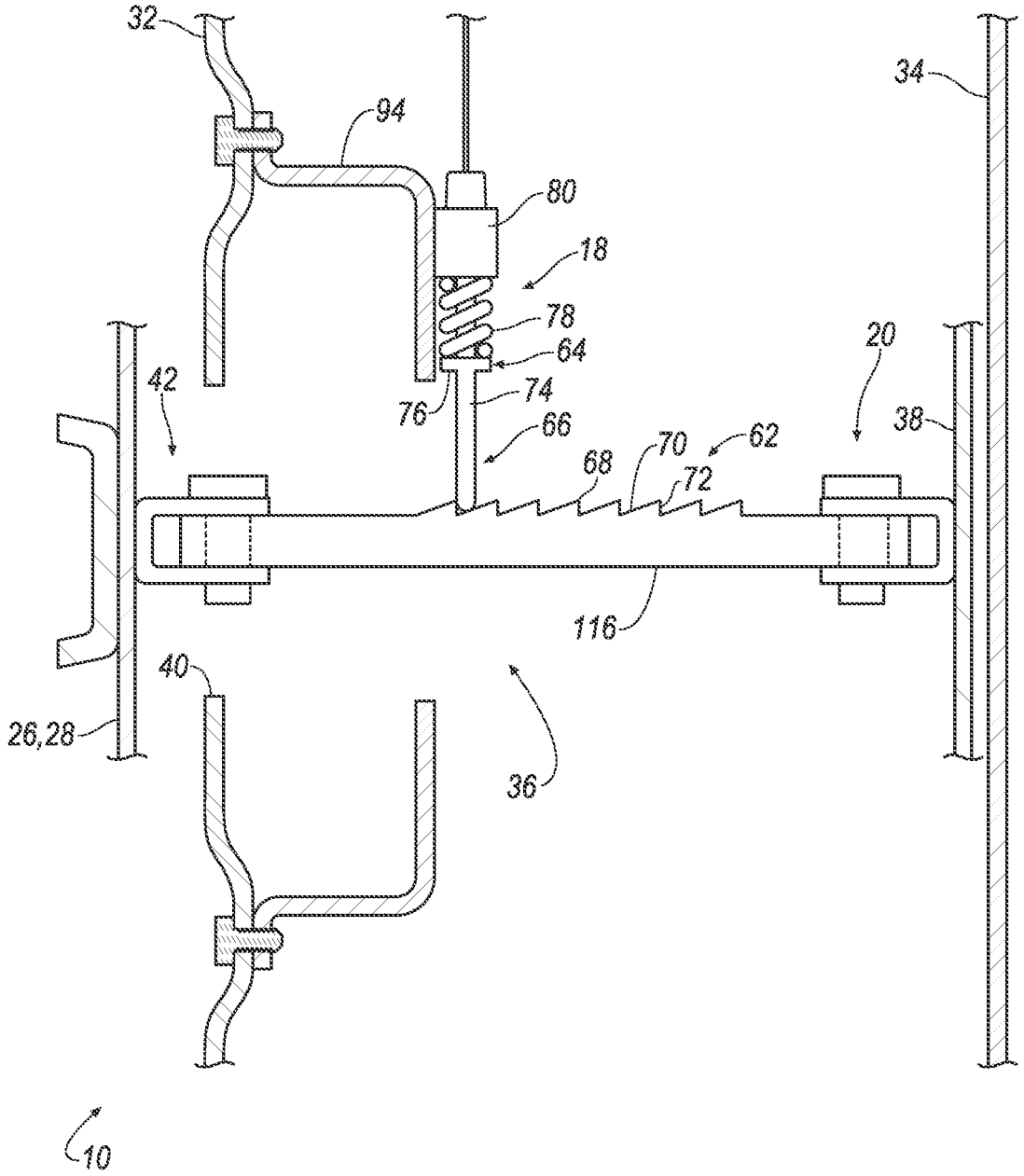
FIG. 7 is a cross-sectional view of a portion of the vehicle along line A of FIG. 1 when the door is in the closed position and including a second embodiment of the check strap corresponding to the second embodiment of the spring shown in FIG. 6.

The door 14 may be moveable between a closed position (shown in FIGS. 1, 3, 6, and 7) and a plurality of open positions (one open position shown in FIGS. 2, 4, and 5). As set forth further below, with reference to FIGS. 2-7, the engagement member 18 may engage the check strap 16, 116 to releasably hold the door 14 in any selected one of the open positions. In other words, when the engagement member 18 is engaged with the check strap 16, 116, the engagement member 18 acts against the bias of the spring 44, 56 to hold the door 14 in the open position. When the engagement member 18 disengages the check strap 16, 116, the spring 44, 56 biases the door 14 to the closed position. In other words, since the spring 44, 56 is positioned to bias the check strap 16, 116 toward the engagement member 18, when the engagement member 18 releases the check strap 16, 116, the spring 44, 56 biases the check strap 16, 116 to pull the door 14 to the closed position. As described further below, a first embodiment of the check strap 16 and spring 44, 56 is shown in FIGS. 2-5, and a second embodiment of the check strap 116 and spring 44, 56 is shown in FIGS. 6-7.

As also set forth further below, the check strap 16 includes a first end 20 pivotally coupled to the door 14 and may include a ramp 22 tapering in a direction away from the first end 20. A pusher 24 may abut the ramp 22 to bias the door 14 toward the closed position. When the engagement member 18 is engaged with the check strap 16, the engagement member 18 acts on the check strap 16 against the bias of pusher 24 to hold the door 14 in the open position. In other words, the engagement member 18 holds the door 14 in the open position and the bias of the pusher 24 is insufficient to overcome the engagement member 18. When the engagement member 18 releases the check strap 16, the pusher 24 biases the door 14 to the closed position to automatically move the door 14 to the closed position, as described further below.

With reference to FIG. 1, the vehicle 12 may include a body 26, and the door 14 may be pivotally supported by the body 26. Specifically, the body 26 may include a hinge pillar 28, and the door 14 may be pivotally supported by the hinge pillar 28. The door 14 may be moveable relative to the body 26 between the closed position and the open positions. The vehicle 12 may include one or more hinges 30 supported by the door 14 and the body 26, and pivotally connecting the door 14 and the body 26, as shown in FIGS. 1 and 6. In the alternative to the hinges 30, the door 14 may be supported by the body 26 in any suitable manner, and may move between the closed position and the open position in any suitable way, e.g., pivotally or otherwise.

With reference to FIGS. 2-7, the door 14 may include a door inner 32 and a door outer 34 fixed to the door inner 32. The door inner 32 and the door outer 34 may be spaced from each other to define a cavity 36 that receives the check strap 16, 116. The check strap 16, 116 may be mounted to the door inner 32 and/or the door outer 34 in the cavity 36. For example, the check strap 16, 116 may be mounted to a bracket 38 of the door inner 32, as shown in FIGS. 2-5 and 7. The door inner 32 and/or the door outer 34 may define an opening 40 and the check strap 16, 116 may extend through the opening 40 from the cavity 36 to the body 26. The door inner 32 and the door outer 34 may be formed of any suitable material, e.g., metal, such as steel, aluminum, etc., or polymer, such as fiber reinforced plastic, sheet molding compound (SMC), etc.

The door assembly 10 shown in FIG. 1 is a front door of a four-door automobile. Any or all of the door assemblies 10 of the vehicle 12 of FIG. 1 may of the type of door assembly 10 shown in FIGS. 2-7. In the alternative to the location and type of door assemblies 10 shown in FIG. 1, the door assembly 10 may be any type of door assembly on any type of vehicle.

The vehicle 12, for example, may be the autonomous vehicle. In other words, the vehicle 12 may be autonomously operated such that the vehicle 12 may be driven without constant attention from a driver, i.e., the vehicle 12 may be self-driving without human input. Specifically, the vehicle 12 may be remotely operated by an automated computer system. When autonomously operated, the vehicle 12 may be used in rental system and/or a ride-share system in which multiple occupants may interchangeably occupy the vehicle 12. The door assembly 10 described herein may be operated to automatically move the door assembly 10 to the closed position before the vehicle 12 is autonomously moved, without or without an occupant inside the vehicle 12.

With reference to FIGS. 1-5 and 7, the check strap 16, 116 extends from the door 14 to the body 26. Specifically, the check strap 16, 116 may include the first end 20 pivotally coupled to the door 14, and a second end 42 pivotally coupled to the body 26. For example, the first end 20 may be pinned to the door 14 and the second end 42 may be pinned to the body 26. Alternatively, the first end 20 may be pivotally coupled to the body 26 and the second end 42 may be pivotally coupled to the door 14. The check strap 16, 116 may be elongated between the first end 20 and the second end 42. The check strap 16, 116 may be formed of any suitable type of material, e.g., plastic, metal, etc.

The check strap 16, 116 may be retractably received by the door 14, as shown in FIGS. 1-5 and 7, as the door 14 is moved to the closed position. Specifically, the check strap 16, 116 may retract into the cavity 36 through the opening 40 when the door 14 is moved to the closed position. The check strap 16, 116 may extend from the cavity 36 between the door inner 32 and the door outer 34 through the opening 40 when the door 14 is moved to open positions. Alternatively, the check strap 16, 116 may be retractably received by the body 26.

As set forth above, the check strap 16, 116 includes the ramp 22 that tapers in a direction away from the first end 20. In FIGS. 2-5, the ramp 22 tapers from the first end 20 and is spaced from the second end 42. Alternatively, the ramp 22 may be disposed at any suitable location between the first end 20 and the second end 42. As shown in FIGS. 2-5, the check strap 16, 116 may include two ramps 22 and two pushers 24 abut the ramps 22, respectively. The check strap 16, 116 may include any suitable number of ramps 22, i.e., one or more.

A first embodiment of the ramp 22, as one example, is shown in FIGS. 2-3, and a second embodiment of the ramp 22, as another example, is shown in FIGS. 4-5. The ramp 22 in FIGS. 2-3 has a constant slope tapering in a direction away from the first end 20. As described further below, in this embodiment, the spring 44 may be a linear spring, i.e., the restoring force of the spring 44 is constant regardless of the compression of the spring 44. The ramp 22 in FIGS. 4-5 has a progressive slope that tapers arcuately, i.e., non-linearly, in a direction away from the first end 20. The slope of the ramp 22 may increase in a direction away from the first end 20. In this embodiment, the spring 44 may be a progressive spring, i.e., the restoring force of the spring 44 increases as the spring 44 is compressed such that the spring 44 becomes stiffer as the spring 44 is compressed.

The check strap 16, 116 may include a stop 46. The stop 46 may, for example, be disposed at the end of the ramp 22 at the first end 20. The stop 46 prevents over-extension of the check strap 16, 116. Specifically, the stop 46 may be positioned, i.e., sized, shaped, and located along the check strap 16, 116, to engage the pusher 24 and/or the engagement member 18 to prevent the pusher 24 from moving past the end of the ramp 22 and/or to prevent the engagement member 18 from moving past the end of the check strap 16, 116 as the door 14 moves to open positions. Therefore, the stop 46 defines a maximum open position of the door assembly 10 relative to the body 26.

As set forth above, the first embodiment of the check strap 16 and spring 44 is shown in FIGS. 2-5, and the second embodiment of the check strap 116 and spring 56 is shown in FIGS. 6-7. With reference to FIGS. 2-5, the first embodiment of the check strap 16 and spring 44 includes the pusher 24 and the ramp 22. As described above, the pusher 24 abuts the ramp 22 and biases the door 14 toward the closed position. Specifically, the pusher 24 may be spring-loaded. For example, the spring 44 may bias the pusher 24 toward the ramp 22. The pusher 24 rides along the ramp 22 as the door 14 is moved between the closed position and the open positions.

With continued reference to FIGS. 2-5, the pusher 24 and the spring 44 may be supported by door 14. The pusher 24 and the spring 44 may be, for example, supported by the door 14 in the cavity 36 of the door 14. Alternatively, the pusher 24 and the spring 44 may be supported by the body 26.

As set forth above, the pusher 24 may be spring-loaded, e.g., the spring 44 biases the pusher 24 toward the ramp 22. With continued reference to FIGS. 2-5, a base 48 may be fixed to the door 14, and the base 48 may retractably support the pusher 24. Specifically, the pusher 24 may include a rod 50 and a block 52 fixed to the rod 50. The rod 50 may be retractably received in the base 48. The spring 44 may be sandwiched between the base 48 and the block 52, such that the spring 44 resiliently compresses when the rod 50 is retracted into the base 48, i.e., when the door 14 is moved toward the open positions.

With continued reference to FIGS. 2-5, the spring 44 may be a coil spring. As set forth above, the spring 44 may be a linear spring, as shown in FIGS. 2-3. As another example, the spring 44 may be a progressive spring, as shown in FIGS. 4-5. In the alternative to the coil spring, the spring 44 may be of any suitable type, e.g., a pneumatic spring, a hydraulic spring, a resiliently compressible polymeric material, etc.

As set forth above, the pusher 24 abuts the ramp 22. Specifically, the pusher 24 may include a roller 54 supported by the block 52 and abutting the ramp 22. The roller 54 may be rotatable relative to the block 52, e.g., with a bearing. In addition, or alternatively, the roller 54 may include a friction reducing coating to aid in movement of the pusher 24 along the ramp 22.

As set forth above, the second embodiment of the spring 56 and the check strap 116 is shown in FIGS. 6-7. With reference to FIG. 6, the spring 56 engages the door 14 and the body 26 and biases the door 14 about the hinge 30 toward the closed position. As shown in FIG. 7, the engagement member 18 may engage the check strap 116 to act against the bias of the spring 56 to hold the door 14 in the open position. When the engagement member 18 disengages the check strap 116, the spring 56 moves the door 14 about the hinge 30 to the closed position.

With continued reference to FIGS. 6-7, the spring 56 and the check strap 116 may be spaced from each other, e.g., vertically spaced. As shown in FIG. 6, the hinge 30 may include hinge halves 58 mounted to the door 14 and the body 26, respectively, and a hinge pin 60 rotatably engaging the hinge halves 58. The spring 56 may be supported on the hinge 30, e.g., engaged with the hinge pin 60.

With continued reference to FIG. 6, the spring 56 may be torsion spring. Alternatively, the spring 56 may be of any suitable type.

With reference to FIGS. 2-5 and 7, the engagement member 18 may be supported by the door 14. For example, the engagement member 18 may be supported by a bracket 94 of the door inner 32. Alternatively, the engagement member 18 may be on the vehicle body 26.

The engagement member 18 is moveable between an engaged position engaged with the strap 16, 116, as shown in FIGS. 2-5 and 7, and a disengaged position disengaged with the check strap 16, 116 (not shown). As one example, a toothed rack 62 may be fixed to the check strap 16, 116, and the engagement member 18 may include a pawl 64 releasably engageable with the toothed rack 62. The toothed rack 62 and the pawl 64 form a ratchet 66 that allows the door 14 to be moved toward the open positions and prevents movement of the door 14 toward the closed position. Specifically, teeth 68 of the toothed rack 62 include a ramped side 70 and a flat side 72. The pawl 64 rides along the ramped side 70 as the door 14 is moved toward the opened positions, and the pawl 64 engages the flat side 72 when the door 14 is biased toward the closed position. The ratchet 66 may be supported by the door 14, or alternatively, may be supported by the body 26.

The toothed rack 62 may be a part of the check strap 16, 116 or may be an independent component separate from the check strap 16, 116. The toothed rack 62 may be integral with the check strap 16, 116, i.e., formed simultaneously with the rest of the check strap 16, 116 as a single continuous unit. Alternatively, the toothed rack 62 may be formed separately from, and subsequently attached to, the check strap 16, 116. The toothed rack 62 may simply be a row of teeth 68 on the check strap 16, 116.

The pawl 64 may be spring-loaded toward the engaged position. Specifically, the pawl 64 may include a post 74 and a pawl spring 78 biasing the post 74 into engagement with the toothed rack 62. A release device 80 (described further below), may retractably receive the post 74, and the pawl 64 may include a ledge 76. The pawl spring 78 may be disposed between the release device 80 and the ledge. In other words, the pawl spring 78 biases the pawl 64 toward the toothed rack 62. As the pawl 64 rides along the ramped side 70 of one of the teeth 68, the pawl spring 78 is loaded. When the pawl 64 reaches the adjacent flat side 72, the pawl spring 78 unloads and pushes the pawl 64 into engagement with the flat side 72. The pawl 64, alternatively, may be a rotary pawl or any other suitable device for engaging the check strap 16, 116.

The spring 44, 56 is positioned to bias the check strap 16, 116 toward the engagement member 18 in the engaged position. Specifically, in the embodiment shown in FIGS. 2-5, the spring 44 biases the pusher 24 against the ramp 22, which biases the door 14 toward the closed position. The spring 44 biases the post 74 of the pawl 64 into engagement the flat side 72 of the tooth 68 adjacent the post 74. Since the flat side 72*s* of the teeth 68 of the toothed rack 62 prevent movement of the door 14 toward the closed position, the spring 44 biases the check strap 16, i.e., the flat side 72 of the tooth, toward the engagement member 18 in the engaged position. In the embodiment shown in FIGS. 6-7, the spring 44 biases the door 14 about the hinge 30 toward the closed position. Similar to the embodiment of FIGS. 2-5, this bias by the spring 44 biases the post 74 of the pawl 64 into engagement with the flat side 72 of the tooth adjacent the post 74.

A release device 80 is engageable with the pawl 64. The release device 80 moves the pawl 64 to the disengaged position to allow the door 14 to move toward the closed position. For example, in the embodiments of the check strap 16, 116 shown in FIGS. 2-5 and 7, the release device 80 retracts the post 74 of the pawl 64 away from the teeth 68 of the toothed rack 62 to allow the door 14 to move toward the closed position, e.g., under the force of the spring.

The release device 80 may be electronically actuated. For example, the release device 80 may be a solenoid engageable with the pawl 64, as shown in FIGS. 2-5 and 7. The solenoid may be mounted to the door 14, e.g., to the bracket 94, and may moveably support the post 74 of the pawl 64. Specifically, the solenoid may retract the post 74 away from the teeth 68 to disengage the post 74 from the teeth 68, and may release the post 74 such that the spring 44, 56 forces the post 74 into engagement with the teeth 68. Alternatively, the release device 80 may be mechanically actuated, e.g., lever operated, link operated, etc.

Figure 8:
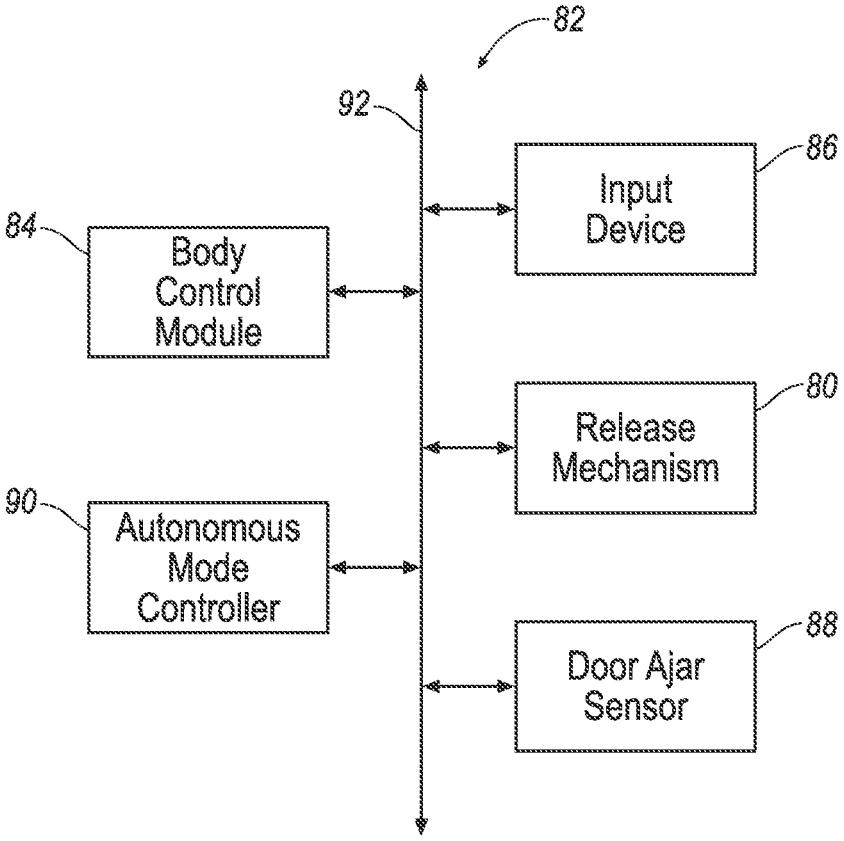
FIG. 8 is a schematic of a control system.

With reference to FIG. 8, the vehicle 12 includes a control system 82 programmed to control the release device 80. The control system 82 may, for example, include a body control module 84 in communication with the release device 80. An input device 86 and a door ajar sensor 88 may be in communication with the body control module 84.

The body control module 84 may include a processor programmed to control the release device 80. For example, the process may be programmed to retract the pawl 64 relative to the toothed rack 62. The processor may be embedded in a microcontroller 54. The microcontroller 54 may include memory, etc. The memory of the microcontroller 54 may store instructions executable by the processor and may read the instructions from the memory and execute the instructions. In order to control the release device 80, the processor communicates with the release, e.g. through a direct electrical wiring, wherein the processor sends an analog or a digital signal to the release device 80, or through a conventional vehicle 12 communication network 92 like CAN (Control Area Network), Ethernet, LIN (Local Interconnect Network) or any other way.

The input device 86 may be supported on the door 14, e.g., the door outer 34, an interior of the door 14, etc. The input device 86 may be accessible to a user and may activated to provide instruction to the body control module 84 to control the release device 80. The input device 86 may be, for example, an electronic or mechanical button in communication with the body control module 84. In this instance, the button may be touched by the user to release the release mechanism such that the door 14 moves to the closed position under the force of the spring. As another example, the input device 86 may be a capacitive sensor on the door outer 34 and or interior of the door 14. The capacitive sensor may detect the touch of a person base 48*d* on capacitive differences resulting from the touch. The capacitive sensor may form a capacitive zone on the door 14 that senses touch of a person. In this instance, the capacitive zone may be touched by the user to release the release mechanism such that the door 14 moves to the closed position under the force of the spring.

The door ajar sensor 88 may sense then the door 14 is in one of the open positions. The body control module 84, e.g., the processor, may be programmed, to move the release device 80 to disengage the check strap 16, 116 in response activation of the input device 86 when the door ajar sensor 88 senses that the door 14 is in one of the open positions. If the door ajar sensor 88 senses that the door 14 is in the closed position, the body control module 84, e.g., the processor, may be programmed to maintain the release device 80 in engagement with the check strap 16, 116 in response to activation of the input device 86. In other words, the body control module 84 may be programmed to move the release device 80 to disengage the check strap 16, 116 only when the door ajar sensor 88 senses that the door 14 is in one of the open positions. For example, the body control module 84 may be programmed to retract the solenoid to pull the post 74 out of engagement with the teeth 68 when the door ajar sensor 88 senses that the door 14 is in one of the open positions and the input device 86 is activated by a user.

As set forth above, the vehicle 12 may be an autonomous vehicle. In this instance, the autonomous vehicle may include an autonomous mode controller 90. The autonomous mode controller 90 may transmit operational data to the vehicle 12. The autonomous mode controller 90 may operate the vehicle 12, for example, based data received from the nearby vehicles and/or a remote server. The remote server, for example, may be a rental vehicle system for returning vehicles to a rental vehicle lot and/or a customer pick-up location. The autonomous mode controller 90 may be programmed to prevent movement of the vehicle 12 when the door ajar sensor 88 senses that the door 14 is in one of the open positions.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A vehicle door assembly comprising:

a door;

a check strap pivotally coupled to the door and including a ramp;

a ratchet including a toothed rack fixed to the check strap and a pawl releasably engageable with the toothed rack; and a spring-loaded pusher abutting the ramp;

wherein the pawl includes a post and a spring biasing the post into engagement with the toothed rack.

2. The vehicle door assembly as set forth in claim 1, wherein the check strap includes a first end pivotally coupled to the door, the ramp tapering in a direction away from the first end.

3. The vehicle door assembly as set forth in claim 1, further comprising a release device engageable with the pawl.

4. The vehicle door assembly as set forth in claim 1, further comprising a solenoid engageable with the pawl.

5. The vehicle door assembly as set forth in claim 1, further comprising a processor programmed to retract the pawl relative to the toothed rack.

6. The vehicle door assembly as set forth in claim 1, wherein at least one of the ratchet and the spring-loaded pusher is supported by the door.

7. A vehicle door assembly comprising:

a door;

a check strap including a first end pivotally coupled to the door and including a ramp tapering in a direction away from the first end;

an engagement member releasably engageable with the check strap, the engagement member being moveable between an engaged position engaged with the check strap and a disengaged position disengaged with the check strap;

a pusher abutting the ramp; and a spring biasing the pusher toward the ramp, the spring being positioned to bias the check strap toward the engagement member in the engaged position.

8. The vehicle door assembly as set forth in claim 7, further comprising a base retractably supporting the pusher.

9. The vehicle door assembly as set forth in claim 7, wherein at least one of the engagement member and the pusher is supported by the door.

10. The vehicle door assembly as set forth in claim 7, further comprising a toothed rack fixed to the check strap, wherein the engagement member is a pawl releasably engaging the toothed rack.

11. A vehicle door assembly comprising:

a door;

a check strap pivotally coupled to the door;

an engagement member releasably engageable with the check strap, the engagement member being moveable between an engaged position engaged with the check strap and a disengaged position disengaged with the check strap;

a spring positioned to bias the check strap toward the engagement member in the engaged position;

a toothed rack fixed to the check strap, wherein the engagement member is a pawl releasably engaging the toothed rack; and another spring biasing the pawl toward the toothed rack.

12. The vehicle door assembly as set forth in claim 11, wherein the check strap includes a first end pivotally coupled to the door and a ramp tapering away from the first end, and further comprising a pusher abutting the ramp.

13. The vehicle door assembly as set forth in claim 12, wherein the spring biases the pusher toward the ramp.

14. The vehicle door assembly as set forth in claim 11, further comprising a hinge supported on the door and biasing the door about the hinge.

15. The vehicle door assembly as set forth in claim 11, wherein at least one of the engagement member and the spring is supported by the door.

* * * * *